US012091142B2

(12) United States Patent
Hallett

(10) Patent No.: US 12,091,142 B2
(45) Date of Patent: Sep. 17, 2024

(54) PADDLECRAFT FOR DIVERS

(71) Applicant: Paul Hallett, Hong Kong (HK)

(72) Inventor: Paul Hallett, Hong Kong (HK)

( * ) Notice: Subject to any disclaimer, the term of this patent is extended or adjusted under 35 U.S.C. 154(b) by 883 days.

(21) Appl. No.: 17/179,932

(22) Filed: Feb. 19, 2021

(65) Prior Publication Data

US 2022/0266965 A1 Aug. 25, 2022

(51) Int. Cl.

| | |
|---|---|
| ***B63C 11/20*** | (2006.01) |
| ***B63B 3/48*** | (2006.01) |
| ***B63B 45/04*** | (2006.01) |
| ***B63H 16/04*** | (2006.01) |

(52) U.S. Cl.

CPC ..... *B63C 11/202* (2013.01); *B63B 3/48* (2013.01); *B63B 45/04* (2013.01); *B63H 16/04* (2013.01)

(58) Field of Classification Search

CPC ..... B63C 11/00; B63C 11/02; B63C 11/12; B63C 11/14; B63C 11/16; B63C 11/18; B63C 11/20; B63C 11/202; B63C 11/205; B63C 11/207; B63C 11/46; B63C 9/28; B63B 3/48; B63B 45/04; B63B 32/70; B63H 16/04

See application file for complete search history.

(56) References Cited

U.S. PATENT DOCUMENTS 361,925 A * 4/1887 Bruce ..... B63C 11/205 128/201.11
4,348,976 A * 9/1982 Gilbert ..... B63C 11/202 128/202.13
4,389,166 A * 6/1983 Harvey ..... F04B 35/04 D15/7
4,674,493 A * 6/1987 Mitchell ..... B63C 11/202 128/201.27
4,832,013 A * 5/1989 Hartdorn ..... B63C 11/202 128/201.27
5,471,976 A * 12/1995 Smith ..... B63C 11/202 128/201.27
5,671,694 A * 9/1997 Schoettle ..... B63C 9/00 441/80
5,996,578 A * 12/1999 MacGregor ..... A62B 9/04 128/201.27
9,789,941 B2 * 10/2017 Smith ..... B63C 11/14
10,793,233 B1 * 10/2020 Morgan ..... B63C 11/26
2018/0362129 A1 * 12/2018 Colborn ..... B63C 11/202
2021/0197938 A1 * 7/2021 Brisard ..... B63C 11/207

FOREIGN PATENT DOCUMENTS

CN 108839775 A * 11/2018

* cited by examiner

*Primary Examiner* — Colin W Stuart
(74) *Attorney, Agent, or Firm* — Eric Hanscom

(57) ABSTRACT

A paddlecraft with a recess in its deck for a hookah diving compressor is disclosed where a user can paddle to a dive site and dive there without removing the compressor from the recess. An interchangeable insert for the recess supports different shapes and sizes of compressors. For a water-cooled compressor, the recess admits water from beneath the paddlecraft, or part of the compressor protrudes through the recess into the water beneath. A lid for the recess with an attachable tube feeds air to the compressor. An airline connection point is integrated into the paddlecraft, readily allowing connection and removal of an airline, or two or more airlines via an adaptor. The paddlecraft can also house an air reserve tank, allowing the user to dive without removing it. If the paddlecraft is an SUP, part of the SUP deck preferably functions as an air reserve tank.

1 Claim, 5 Drawing Sheets

PADDLECRAFT FOR DIVERS

CROSS REFERENCE TO RELATED APPLICATIONS

None.

STATEMENT REGARDING FEDERALLY SPONSORED RESEARCH OR DEVELOPMENT

This invention was not federally sponsored.

BACKGROUND OF THE INVENTION

Field of the Invention

This invention relates to the general field of paddlecraft, being waterborne vessels such as kayaks and stand up paddle boards (SUP's) that are powered only by their users with single or double-bladed paddles. More specifically, the invention relates to a paddlecraft with a recess in its deck to house a hookah diving compressor, so that the user may paddle to a dive site and dive there without removing the compressor from the recess.

Kayaks and SUP's are popular ways for outdoor enthusiasts to explore an ocean coastline or lake: paddling without an engine is not only environmentally friendly, it allows the nature lover to quietly observe birds, seals, dolphins, whales and other wildlife.

Particularly in warmer water, it's natural to want to also explore below the surface. In theory at least, paddling to a dive site under one's own steam would forgo the need to join an organized trip in a larger motor-powered dive boat, thus providing a cheap, flexible and environmentally friendly way to dive.

In practice however, while many users of kayaks and SUPs enjoy diving, only a small hardcore of enthusiasts—known as "kayak divers"—have managed to combine these activities. This is because diving from a kayak or SUP is fundamentally difficult. Scuba tanks need to be securely strapped to avoid loss, yet upon accidental capsize, their weight makes it very hard for the user to right the craft. Unstrapping scuba tanks and reattaching them after a dive is far from easy. Further, the user needs to anchor the craft to avoid it drifting away while diving, yet doing so can easily damage coral and fragile marine ecosystems. Add to which, the user can drift a long way while diving, making it hard to spot a small craft after surfacing, and dangerously difficult for a tired user to return to it, when swimming against a current.

There exist kayaks with adequate space and buoyancy to transport scuba equipment to a dive site. For example, the Ocean Kayak Scupper and Scupper Pro models are both capable of storing scuba tanks, weight belts and buoyancy compensators. However, such kayaks either i) rely on molded wells above water level for storage, destabilizing the kayak in the case of heavy scuba equipment; or ii) rely on deeper hatches, in which equipment will easily roll around, likewise destabilizing the kayak. Removing and replacing heavy equipment from such hatches is also notoriously difficult, particularly on a wavy sea.

There are also kayaks that slide open at the seat to allow for a diver to more easily enter and exit the water, such as the kayak described in U.S. Pat. No. 10,442,508 to Hallett. However, easy access to the water does not solve the problem of storing and accessing scuba equipment, nor the dangers of a destabilized kayak.

Diving from an SUP is even more problematic, as its thin, flat deck has no room for wells or hatches to store scuba equipment. Lashing heavy equipment to its deck can easily destabilize the SUP when the user is standing, particularly when the water is a little rough. With inflatable SUP's, there is also a danger that a sharp edge of a piece of equipment will puncture the fabric of the SUP, resulting in immediate deflation.

Whether scuba diving from a kayak or an SUP, the diver needs to anchor the craft, and that can cause serious environmental damage. Coral reefs are popular diving destinations, and the damage to them from anchors and anchor chains is well known: with the average coral reef between 5,000 and 10,000 years old, anchor damage may take hundreds of years to recover. Many countries, and states within the United States have an outright ban on dropping anchors in or near a coral reef—a pleasure boat owner in Hawaii for example was recently fined 100,000 for anchoring on coral.

Thus, there exists a need for paddlecraft that allows the user a cheap and simple way to combine the pursuits of diving and paddling, in a manner that does not endanger the environment or the stability/safety of the paddlecraft.

BRIEF SUMMARY OF THE INVENTION

The current invention provides just such a solution by incorporating a recess in the deck of a paddlecraft into which a hookah diving compressor can be placed, in a manner that lowers the center of gravity of the paddlecraft, thus aiding stability. Once the user has paddled to a dive site, the compressor can remain in the recess, allowing the user to dive with minimal preparation. The user is connected to the compressor (and hence the paddlecraft) via an airline, removing the risk of becoming separated from the paddlecraft while diving. This also alleviates the need for an anchor, and the environmental damage that can cause.

The invention also contemplates a lid for the recess that allows attachment of a vertical tube to feed clean air to the compressor, its open end safely above waves and spray, with the option for this vertical tube to also function as the mast for a "diver down" flag.

The invention further contemplates an interchangeable insert for the recess, allowing the recess to stably house different shapes and sizes of compressor. This allows a user to choose a compressor with preferred specifications, for example a more powerful compressor for deeper diving, and avoids the chosen compressor moving around loosely in the recess (with risk the compressor ceases to work and/or the paddlecraft becomes less stable).

Some compressor models are designed to have their bases submerged in water, to stop them from overheating. One embodiment of the invention allows the recess to admit water, to cool such a compressor while in use. A further embodiment allows the compressor to protrude through the base of the recess into the water beneath, with the same purpose.

The invention also contemplates an airline connection point integrated into the paddlecraft, so that the user can conveniently attach and remove an airline, or two or more airlines via an adaptor.

In the case the paddlecraft is an SUP, a further embodiment of the invention allows a hollow portion of the SUP's deck to function as an air reserve tank for the user.

OBJECTS OF THE INVENTION

It is therefore an object of the present invention to provide a paddlecraft that allows the user an environmentally friendly way to reach a dive site, and dive there easily and safely.

An additional object of the invention is to allow the user to place a hookah diving compressor in the paddlecraft, in a manner that allows the user to dive without removing the compressor from the paddlecraft.

A further object of the invention is for the paddlecraft recess to stably house different shapes and sizes of hookah diving compressors.

Another object of the invention is to allow the hookah diving compressor to be water-cooled, in the case of a compressor that requires this.

A further object of the invention is to safely provide a feed of clean air to the compressor.

Another object of the invention is to make it easy for the user to attach/remove one or more airlines, to support one or more divers.

An additional object of the invention is for the paddlecraft to include/house an air reserve tank, in a manner that doesn't impede upon the paddlecraft's usable space.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

It should be understood the while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

DETAILED DESCRIPTION OF THE INVENTION

Figure 1:
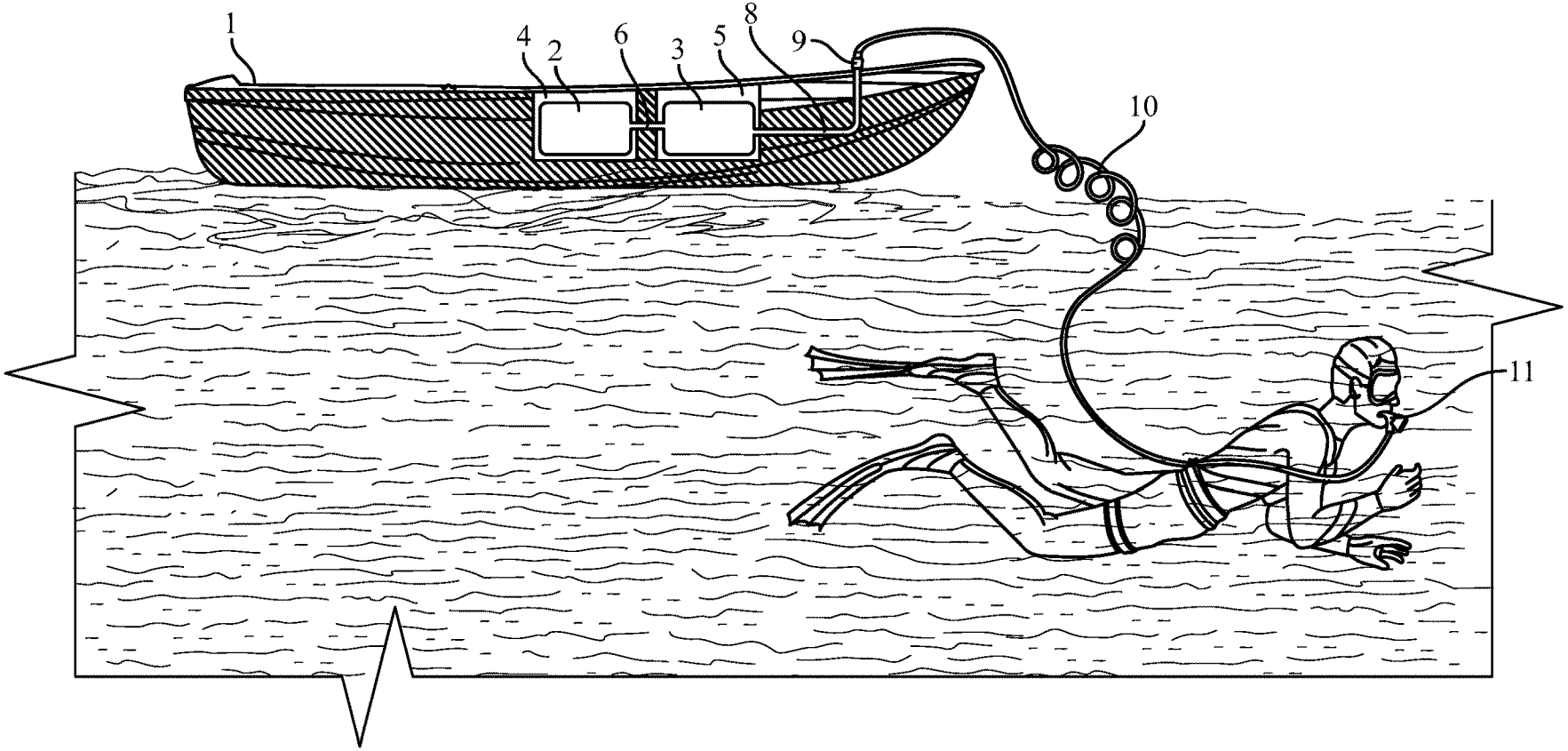
FIG. 1 is a cross-sectional view of one embodiment of the invention, where the hookah diving compressor and air reserve tank are housed in separate recesses in the paddlecraft deck.

Many aspects of the invention can be better understood with references made to the drawings below. The components in the drawings are not necessarily drawn to scale. Instead, emphasis is placed upon clearly illustrating the components of the present invention. Moreover, like reference numerals designate corresponding parts through the several views in the drawings. Before explaining at least one embodiment of the invention, it is to be understood that the embodiments of the invention are not limited in their application to the details of construction and to the arrangement of the components set forth in the following description or illustrated in the drawings. The embodiments of the invention are capable of being practiced and carried out in various ways. In addition, the phraseology and terminology employed herein are for the purpose of description and should not be regarded as limiting.

FIG. 1 shows a preferred embodiment of the invention, with the paddlecraft 1 housing the compressor 2 and the air reserve tank 3 in separate recesses (4 and 5 respectively). A first connecting tube 6 within the paddlecraft connects them, so that the compressor 2 when turned on feeds air to the air reserve tank 3. A second connecting tube 8 connects the air reserve tank 3 to an airline connection point 9, preferably integrated into the prow of the paddlecraft 1. An airline 10 is then connected at one end to the airline connection point 9, and at the other end preferably by a clip to the user's weight belt or to a harness on the user's back, and then to a regulator 11 through which the user breathes.

With the airline connection point 9 preferably integrated into the prow of the paddlecraft 1, when the user dives, the paddlecraft is thus towed behind the user in a manner that provides least resistance to forward motion. More generally, towing the paddlecraft has the advantage the user can't become separated from it, as when scuba diving from a paddlecraft, with the risk of losing the paddlecraft altogether, or a long swim against a current to regain it after surfacing. It also means the paddlecraft doesn't need to be anchored, thus lowering the risk of damaging coral and fragile marine ecosystems.

Figure 2:
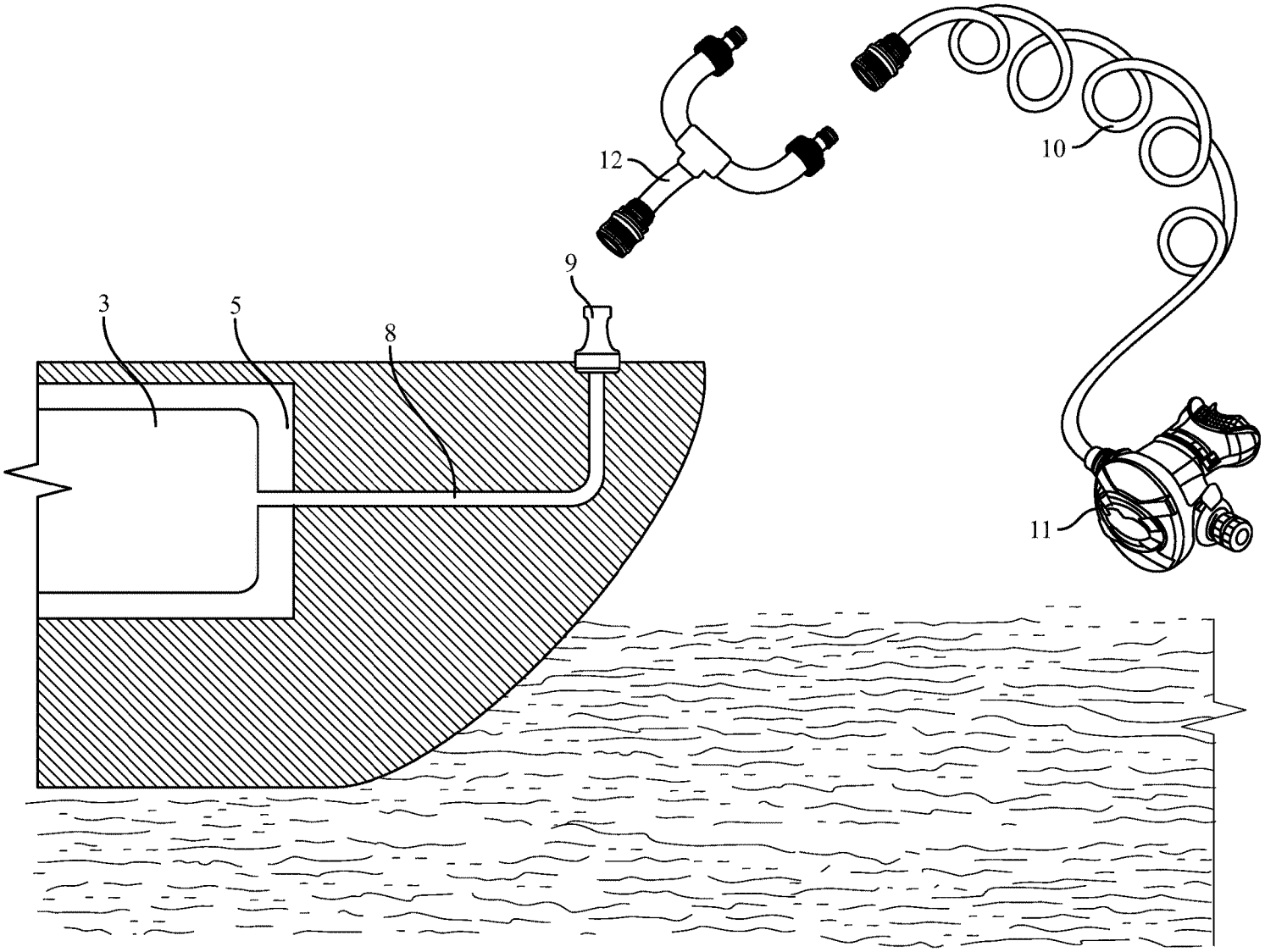
FIG. 2 is cross-sectional detail view showing one preferred embodiment of an airline connection point integrated into the prow of the paddlecraft.

With reference to FIG. 2, the airline connection point 9 is preferably the male side of a standard air compressor quick release valve, typically made from metal and/or high-grade plastic. This airline connection point is preferably secured firmly (for example using glue or a screw mounting) in the prow area of the paddlecraft, allowing the user to easily attach and detach an airline 10, one that includes the female side of the same connector.

Still with reference to FIG. 2, the user could optionally attach an airline adaptor 12 to the airline connection point 9, allowing two or more airlines 10 to be attached, via the adaptor, to the airline connection point 9. While FIG. 2 shows a standard T-adaptor, allowing two airlines to be attached, it would be possible to use a single adaptor that allowed attachment of three or more airlines, or join two or more T-adaptors with the same aim.

Use of one or more adaptors in this manner allows the invention to support two or more users diving simultaneously. For example, the paddlecraft could have two seats, with both users paddling, and both users diving together once a dive site was reached. Alternatively, two or more users could paddle together to a dive site in separate paddlecraft, with one of these paddlecraft (the present invention) then able to support two or more users from the group diving simultaneously.

A further contemplated embodiment would be for the compressor (2 in FIG. 1) to link via a connecting tube within the paddlecraft 1 directly to the airline connection point 9, i.e. compressed air from the compressor 2 would then reach the airline connection point 9 without first passing through an air reserve tank. An air reserve tank could then optionally be included in the airline 10, such that it floated on the water while the user was diving.

Figure 3:
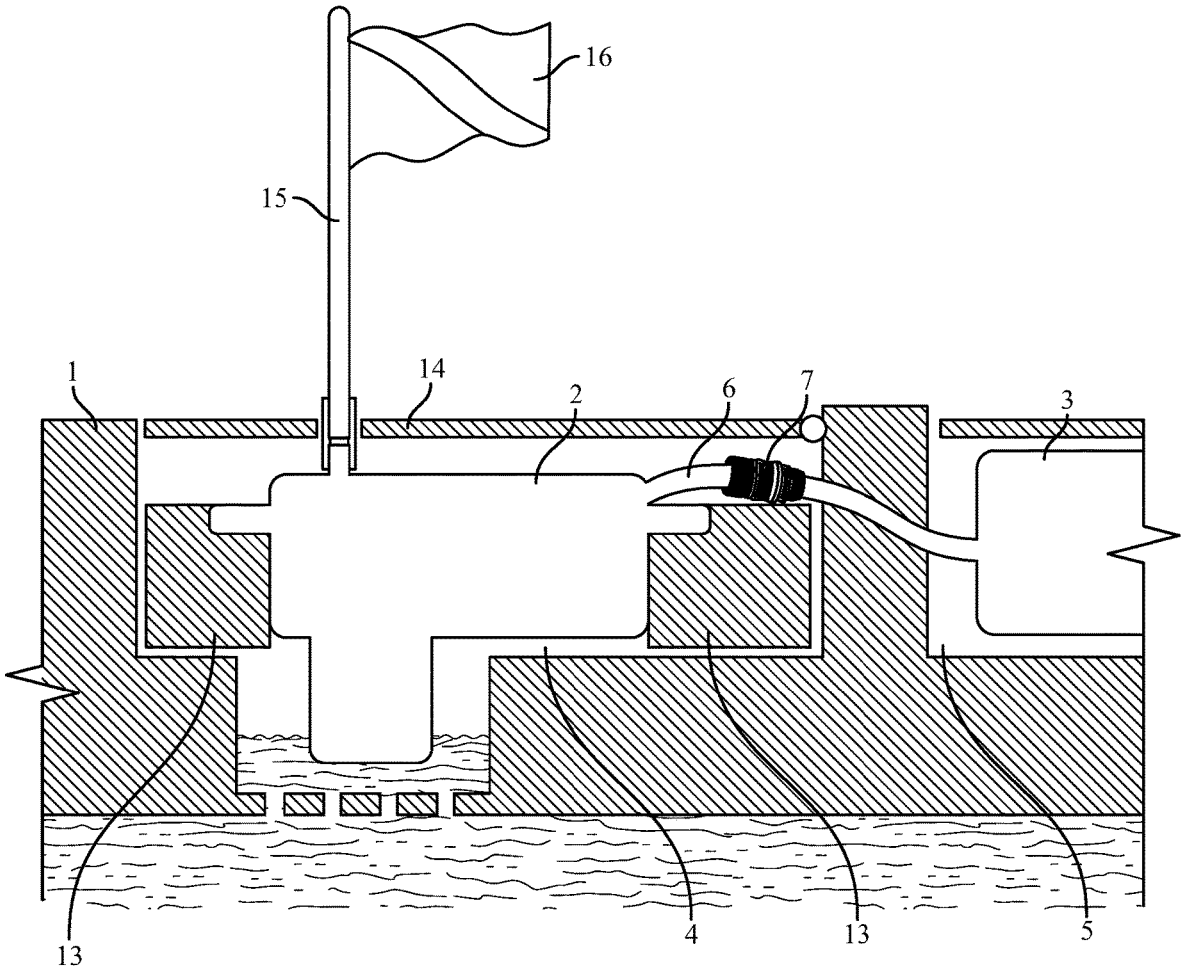
FIG. 3 is a cross-sectional detail view showing one preferred embodiment of the recess used to house the compressor.

With reference to FIG. 3, a standard compressor quick release valve 7 is also preferably incorporated into the first connecting tube 6, connecting the compressor 2 and the air reserve tank 3. This allows the compressor 2 to be easily placed into the compressor recess 4 prior to a dive outing, and removed from the recess after the outing. The user may naturally want to do this because a) the compressor is relatively heavy, making it harder to lift the paddlecraft in and out of the water with the compressor in the recess; b) the compressor is relatively expensive, meaning the user may not wish to leave this unattended in a moored paddlecraft; and c) some compressors are sealed units that include rechargeable batteries (and hence need to be removed from the paddlecraft recess for recharging).

In contrast, the air reserve tank 3 is relatively cheap and light, made typically of plastic or ceramic, and would more naturally be left by the user in the air reserve tank recess 5 after a dive outing.

Still with reference to FIG. 3, in a preferred embodiment of the invention, the compressor recess 4 has a compressor recess lid 14, preferably a plastic hinged lid, the kind often seen covering a central hatch in the deck of a sit on top kayak. This lid preferably has a small hole, large enough to insert an air tube, namely the compressor air inlet tube 15. This compressor air inlet tube 15 is preferably made of hard plastic, and rises vertically from the hole in the compressor recess lid 14, preferably linked to the compressor 2 at its base using a softer plastic tube of slightly wider diameter. Air thus enters from the top end of the compressor air inlet tube 14, safely above waves and spray, to feed the compressor when in use, even if the paddlecraft itself were to become waterlogged.

The compressor air inlet tube 15 can optionally serve as a mast for a diver down flag 16, being a flag commonly used by divers to let others know that their paddlecraft is unattended while they are diving beneath it. The air inlet tube and flag can easily be removed after a dive, and stored preferably in the compressor recess 4.

Still with reference to FIG. 3, the compressor recess 4 accepts a compressor recess insert 13 preferably made from foam or rubber, molded to encircle the base of a given shape and size of compressor, and keep it stable within the recess. This allows a user to choose a compressor with preferred specifications, for example a more powerful compressor for deeper diving, and avoids the chosen compressor moving around loosely in the recess (with risk the compressor ceases to work and/or the paddlecraft becomes less stable).

Hookah diving compressors are commonly designed to have their bases submerged in water, to cool them while in use. FIG. 3 shows such a compressor, with the base of the compressor recess 4 preferably admitting water from below the paddlecraft via one or more small holes. Water entering the recess is thus confined to the recess itself, with the compressor recess insert 13 preventing it from sloshing to rise above the compressor 2. Importantly, in the case of a sit-on-top kayak, this water in the recess may not enter the primary shell of the kayak, and therefore will not compromise its buoyancy.

Water entering the compressor recess 4 will therefore rise naturally to a level equal in height to the level of the water surrounding the paddlecraft 1. The base of compressor thus sits in a small well of water within the compressor recess, with that water able to circulate through the one or more small holes with the larger body or water beneath the paddlecraft, thus cooling the compressor.

It is contemplated that a number of hole designs could be used, including forward-angled holes that would "scoop in" more water to increase cooling, or backward-angled holes that would naturally "lose" water from the recess. It is further contemplated that the size and location of the holes could be varied depending on the type of circumstances the paddlecraft was designed to operate in.

With this embodiment, if the compressor recess was being used to house a compressor that did not require water-cooling, or if the paddlecraft was being used without a compressor altogether, the hole(s) in the compressor recess floor could be temporarily blocked to make the recess watertight, for example using rubber or plastic plug(s), or by simply covering the hole(s) on the underneath of the paddlecraft with a waterproof tape. Of course, if the compressor recess was only ever to be used to house a compressor that did not require water-cooling, there would be no need for holes in the recess floor to admit water.

Figure 4:
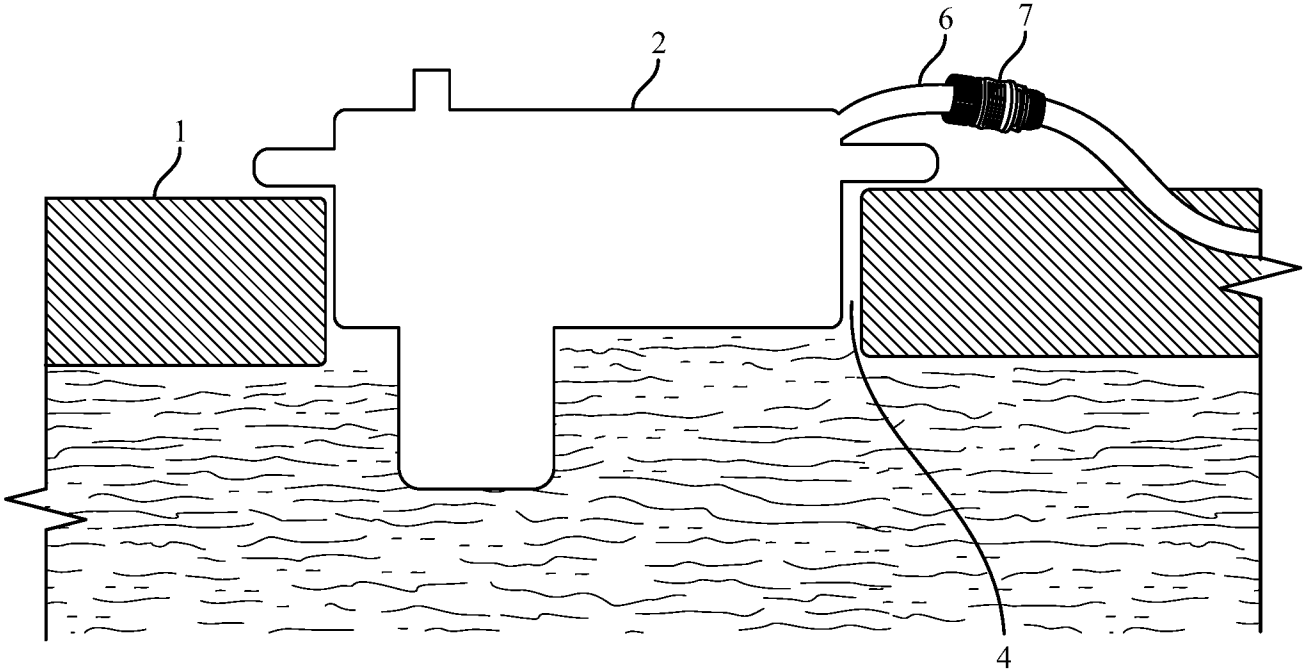
FIG. 4 is cross-sectional detail view showing one preferred embodiment of a recess that allows the compressor to protrude through its base into the water below.

FIG. 4 shows a further embodiment of the invention where a water-cooled compressor 2 has its base protruding through the compressor recess 4 into the water beneath. This would particularly suit a paddlecraft such as an SUP where the deck has less thickness. The compressor could optionally also protrude out the top of the deck, with no recess lid, as shown in FIG. 4, with a flange on the compressor, and/or a compressor recess insert used to prevent it falling through the recess altogether.

With such an embodiment—one that also allows the compressor to protrude out the top of the recess—removable straps across the top of the compressor would be used to preferably keep the compressor more stably in the recess, so that even if the paddlecraft were to capsize, the compressor would remain secured.

Whether the compressor sits in a recess (as in FIG. 3) or protrudes beneath it (as in FIG. 4), inclusion of the compressor lowers the combined center of gravity of the paddlecraft plus its user, thus aiding its stability.

Figure 5:
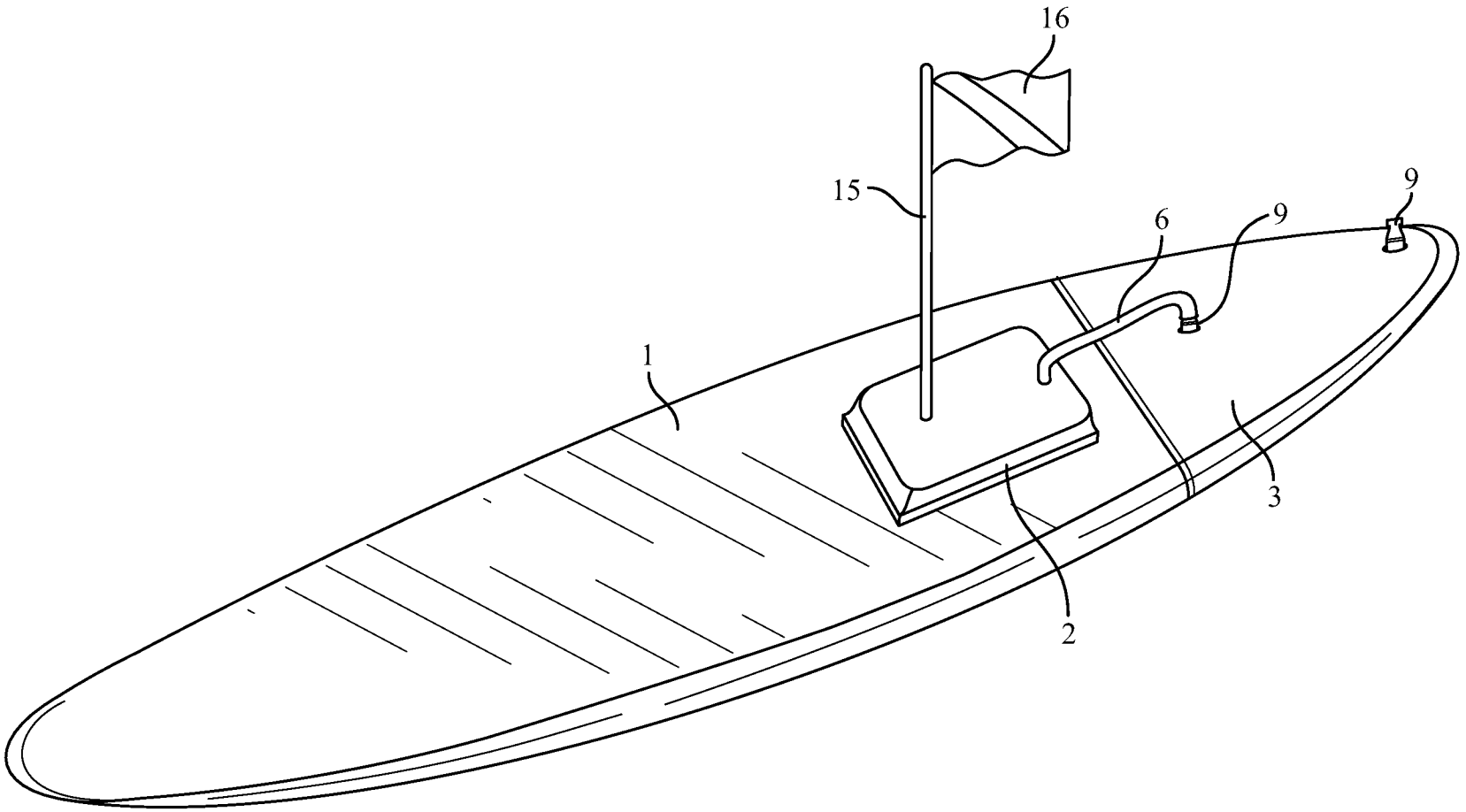
FIG. 5 is perspective view showing one preferred embodiment of the invention where a hollow portion of the deck of an SUP serves as an air reserve tank.

FIG. 5 shows a further preferred embodiment of the invention where the paddlecraft 1 is an SUP, and part of the SUP's deck—preferably the prow—is hollow and engineered to withstand higher pressure, so it can function as an air reserve tank 3 for the user while diving. The air reserve tank 3 is preferably engineered to include two airline connection points 9, so that a connecting tube 6 can link the compressor to the first airline connection point, and the diver's airline can be connected to the second airline connection point (shown in FIG. 5 at the front tip of the SUP deck).

While FIG. 5 shows the connecting tube 6 above the SUP deck, it could instead be situated below the deck, linking to an airline connection point on the underside of the air reserve tank 3. Note in this respect that some popular hookah compressors have a tube expelling compressed air on their undersides, and in the case of an SUP, it would be most natural for the compressor's underside to protrude below the deck (because the deck of an SUP is thin).

While in FIG. 5 the air reserve tank 3 is the whole of the tip of the SUP deck, it could instead be engineered as an insert, preferably of the same or similar thickness to the remainder of the SUP deck, to fit into a hole of the same size in the deck and preferably secured by straps in that hole.

While FIG. 5 shows the compressor 2 sitting in a recess in the main portion of the deck (the portion that is not the air reserve tank 3), the air reserve tank 3 could instead include a recess for the compressor.

The preferred embodiments illustrated in all the drawings assume the compressor 2 is a unit consisting of the compressor itself, and an integrated battery power supply, but not including an air reserve tank. The power supply however could optionally be separate from the compressor, stored in the same compressor recess 4, or a different recess, while the air reserve tank could optionally be integrated into the compressor unit.

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

REFERENCE NUMERALS USED

1. Paddlecraft
2. Compressor (a hookah diving compressor)
3. Air reserve tank
4. Compressor recess
5. Air reserve tank recess
6. First Connecting tube (connecting compressor to air reserve tank)
7. Connecting tube quick release valve
8. Second Connecting tube (connecting air reserve tank to airline connection point)
9. Airline connection point
10. Airline
11. Diving regulator
12. Airline adaptor
13. Compressor recess insert
14. Compressor recess lid
15. Compressor air inlet tube
16. Diver down flag That which is claimed:

1. A paddlecraft, comprising a paddlecraft deck with a recess in the paddlecraft deck, wherein the recess houses a compressor, wherein a diver can paddle the paddlecraft to a dive site and perform a dive at the dive site without removing the compressor from the recess, wherein air breathed by the diver during the dive has been compressed by the compressor then fed to the diver via an airline, wherein a lowest part of the compressor protrudes through a recess bottom such that the lowest part of the compressor is submerged in a water body below the paddlecraft, such that the water body cools the compressor while the compressor is in use.

* * * * *